United States Patent [19]

Frei

[11] Patent Number: 4,993,653

[45] Date of Patent: Feb. 19, 1991

[54] APPARATUS FOR ROTATABLY SUPPORTING A HOLLOW, SUBSTANTIALLY CYLINDRICAL WINDING CORE, AND WINDING CORE FOR SUPPORTING A COIL OF FLEXIBLE, SUBSTANTIALLY FLAT PRODUCTS, ESPECIALLY PRINTED PRODUCTS

[75] Inventor: Hans Frei, Oetwil am See, Switzerland

[73] Assignee: Ferag AG, Hinwil, Switzerland

[21] Appl. No.: 306,092

[22] Filed: Feb. 3, 1989

[30] Foreign Application Priority Data

Feb. 5, 1988 [CH] Switzerland ..... 00405/88

[51] Int. Cl.[5] ..... B65H 16/02; B65H 75/02

[52] U.S. Cl. ..... 242/59; 242/55; 242/68.5

[58] Field of Search ..... 242/55, 59, 67.1 R, 242/67.3 R, 68–68.7

[56] References Cited

U.S. PATENT DOCUMENTS 4,296,891 10/1981 Sideway et al. .
4,682,741 7/1987 Honegger ..... 242/68.5 X
4,741,487 5/1988 Balass ..... 242/59
4,755,111 10/1988 Kalin ..... 242/59
4,832,273 5/1989 Honegger ..... 242/68.5 X

*Primary Examiner*—Stuart S. Levy
*Assistant Examiner*—Steven M. duBois
*Attorney, Agent, or Firm*—Willian Brinks Olds Hofer Gilson & Lione

[57] ABSTRACT

A rotatably mounted support arrangement comprises two receiving claws having substantially V-shaped grooves. Diametrically opposite these receiving claws there are provided two clamping claws which also comprise substantially V-shaped grooves. A winding core comprises on the inner side thereof an annular rim or rib having a substantially V-shaped configuration. This annular rim or rib is supported in the grooves of the receiving claws and is pressed against the latter by means of the clamping claws. For releasably clamping the winding core, the clamping claws can be brought from an idle or ineffectual position, in which the clamping claws do not bear against the winding core, into an operative or effectual position in which the clamping claws clamp or fixedly hold the winding core together with the receiving claws. The winding core with the product core or wound package thereof is clamped at the supporting arrangement and rotatably supported conjointly with the latter.

25 Claims, 2 Drawing Sheets

APPARATUS FOR ROTATABLY SUPPORTING A HOLLOW, SUBSTANTIALLY CYLINDRICAL WINDING CORE, AND WINDING CORE FOR SUPPORTING A COIL OF FLEXIBLE, SUBSTANTIALLY FLAT PRODUCTS, ESPECIALLY PRINTED PRODUCTS

CROSS-REFERENCE TO RELATED PATENTS AND PATENT APPLICATIONS

This application is related to the commonly assigned U.S. Pat. No. 4,795,105 granted Jan. 3, 1989, entitled: "PACKAGE SUPPORT DEVICE FOR THE INTERMEDIATE STORAGE OF WOUND-UP PRINTED PRODUCTS, SUCH AS NEWSPAPERS, PERIODICALS AND THE LIKE", U.S. Pat. No. 4,768,768 granted Sept. 6, 1988, entitled: "APPARATUS FOR PROCESSING PRINTED PRODUCTS, USING A MOBILE WINDING AND UNWINDING BAND STORAGE UNIT", U.S. Pat. No. 4,705,227 granted Nov. 10, 1987, entitled: "APPARATUS FOR WINDING-UP AND UNWINDING CONTINUOUSLY ARRIVING FLEXIBLE FLAT STRUCTURES", U.S. Pat. No. 4,641,795 granted Feb. 10, 1987, entitled: "PRINTED PRODUCT COIL" and U.S. Pat. No. 4,593,865 granted June 10, 1986, entitled: "WINDING MANDREL FOR A COIL OR WOUND PACKAGE FORMED OF FLEXIBLE, SUBSTANTIALLY FLAT PRODUCTS, ESPECIALLY PRINTED PRODUCTS".

This application is also related to the commonly assigned, copending U.S. patent application Ser. No. 07/202,820, filed June 6, 1988, entitled: "MOBILE STORAGE UNIT FOR PROCESSING PRINTED PRODUCTS, SUCH AS NEWSPAPERS, PERIODICALS AND THE LIKE", U.S. patent application Ser. No. 07/163,346, filed Mar. 2, 1988: entitled: "APPARATUS FOR THE CONTINUOUS WINDING-UP OR WINDING-OFF OF SUBSTANTIALLY FLAT STRUCTURES INTO A PACKAGE AND FROM A PACKAGE, RESPECTIVELY", and U.S. patent application Ser. No. 07/042,329, filed Apr. 24, 1987, entitled: "METHOD OF, AND APPARATUS FOR, PROCESSING PRINTED PRODUCTS, ESPECIALLY NEWSPAPERS, PERIODICALS AND THE LIKE".

BACKGROUND OF THE INVENTION

The present invention broadly relates to winding or unwinding apparatuses for the winding-up of substantially flat structures into a product coil or wound package and the winding-off of such flat structures from a product coil or wound package and, more specifically pertains to a new and improved construction of an apparatus for rotatably supporting or mounting a hollow, substantially cylindrical winding core or mandrel for rotation about the longitudinal axis thereof and for supporting on the outer or external side or surface thereof a product coil or wound package formed of flexible, substantially flat products, especially printed products. The present invention also relates to a winding core for employment with such an apparatus.

Generally speaking, the apparatus of the present invention comprises a support arrangement having at least one support element on which the winding core or mandrel can be brought to bear thereupon, and at least one pressing element which can be brought from an idle or ineffectual position into an operative or effectual position for pressing the winding core or mandrel against the at least one support element.

Such an apparatus is known, for example, from the European Patent Publication No. 0,161,569 and its cognate U.S. Pat. No. 4,601,436, granted July 22, 1986. The support arrangement of the apparatus known to the art comprises two support wheels, the axes of which are substantially parallel to one another. These two support wheels are rotatably and drivably mounted at a frame and form part of a friction wheel drive arrangement which further comprises an annular or ring-shaped friction wheel. This annular or ring-shaped friction wheel simultaneously constitutes the winding core upon which printed products are wound up conjointly with a winding strap. The exposed inner surface of the winding core comes into contact with the two support wheels and serves as a traction surface which is laterally delimited by inwardly projecting side flanges. The longitudinal axis of the winding core deposited upon the support wheels thus extends in a direction substantially parallel to the axis of rotation of the support wheels. A guide wheel is arranged beneath and in the center between the support wheels. This guide wheel can be brought from an idle position into an operative position, in which the guide wheel also bears against the exposed inner surface of the winding core, in order to press the winding core against the two support wheels. This known apparatus is associated with a relatively high constructional expenditure, considering the fact that both support wheels have to be driven and that a guide wheel must be provided to prevent slippage of the friction wheel drive arrangement.

In a winding core as known, for example, from European Patent Publication No. 0,236,561 and its cognate U.S. patent application Ser. No. 07/005,698, filed Jan. 22, 1987, the outer or external side thereof comprises a supporting surface for carrying a product coil or wound package formed of printed products. The printed products are wound up conjointly with a winding band or strap which at one end is fixedly attached to the winding core. The winding core comprises a groove for the winding band, such groove being open towards the outer or external side. On the inner or internal side of the winding core there are arranged two circumferential ribs which are located in planes extending in a direction substantially perpendicular to the longitudinal axis of the winding core, such planes extending beyond the center of gravity of the winding core. For rotatably supporting this winding core it is thus required that the winding core is either supported on both ribs or then only on one rib, whereby an axial support of the winding core is necessary if a tilting-off thereof is to be prevented.

SUMMARY OF THE INVENTION

Therefore, with the foregoing in mind, it is a primary object of the present invention to provide a new and improved apparatus for rotatably supporting or mounting a hollow, substantially cylindrical winding core, which apparatus does not exhibit the aforementioned drawbacks and shortcomings of the prior art.

Another and more specific object of the present invention aims at providing a new and improved apparatus for rotatably supporting a hollow, substantially cylindrical winding core which is structured to carry on the external side or surface thereof a coil or wound package formed of flexible, substantially flat products, especially printed products, which apparatus is relatively simple in construction and design, economical to manufacture, highly reliable in operation and not readily subject to breakdown and malfunction.

Yet a further significant object of the present invention is to provide a new and improved construction of a hollow, substantially cylindrical winding core, the novel design of which is particularly advantageously suitable for the inventive apparatus for rotatably supporting such a winding core. The winding core constructed according to the invention is also extremely simple in design and permits simple and essentially trouble-free manipulation of the empty as well as of the full winding core.

Now in order to implement these and still further objects of the invention, which will become more readily apparent as the description proceeds, the apparatus for rotatably supporting or mounting a hollow, substantially cylindrical winding core as contemplated by the present invention, among other things, is manifested by the features that the at least one support element together with the at least one pressing element forms a clamping arrangement for releasably clamping the winding core to the support arrangement, and that the support arrangement is rotatably mounted for rotation about an axis of rotation which substantially coincides with the longitudinal axis of the winding core clamped to or releasably fixedly held at the support arrangement.

The support element and the pressing element clamp the winding core to the support arrangement such that the winding core co-rotates with the support arrangement upon rotation of the latter. A smooth running is thus achieved because no relative movements can occur or arise between the support arrangement and the winding core. The apparatus can thus be conceived relatively simple in design and construction since the complete or entire support arrangement can be rotatably supported and only the support arrangement itself is to be constructed as the clamping arrangement for the winding core.

In a preferred construction of a simple embodiment of the invention, the support element and the pressing element comprise substantially V-shaped grooves which, in the case of the pressing element being in the operative or effectual position, are arranged in a plane extending in a direction substantially perpendicular to the axis of rotation of the support arrangement. This constructional measure allows for large tolerances for the entire support arrangement containing the support element and the pressing element as well as for the winding core. Moreover, a winding core deposited upon the support arrangement, for example, in offset or inaccurate manner is automatically centered and aligned by the substantially V-shaped grooves, with the beneficial result that simple handling is ensured and that a good stability can thereby be achieved.

As alluded to above, the invention is not only concerned with the aforementioned apparatus for rotatably supporting a hollow, substantially cylindrical winding core, but also relates to a novel construction of such a hollow, substantially cylindrical winding core which is particularly suitable for the rotatable and removable support or mounting thereof at a support arrangement of the apparatus constructed according to the invention.

Generally speaking, the inventive winding core comprises at the external or outer side thereof a supporting or carrying surface for carrying or bearing a product coil or wound package formed of elastic, substantially flat products, especially printed products, and at the internal or inner side thereof a mounting element for the rotatable and removable support of the winding core at the support arrangement.

The inventive winding core, in its more specific aspects, is manifested by the feature that the mounting element comprises a substantially V-shaped cross-section.

The winding core is deposited with its mounting element upon the support element, and each provided pressing element acts upon the mounting element in such a manner that the winding core is clamped to the support arrangement.

A particularly stable and positively centered connection between the winding core and the support arrangement,—such connection allowing for large tolerances at the winding core as well as at the support arrangement—, can then be achieved when the support element and the pressing element comprise portions or regions structured for being brought to bear against the winding core, such portions or regions being formed to have a substantially V-shaped configuration.

In a particularly advantageous embodiment of the winding core, the mounting element is formed by an annular rim or rib projecting inwardly and constructed essentially as a substantially V-shaped wedge. This advantageous embodiment of the winding core is particularly suited to the support arrangement in which the aforesaid portions or regions of the support element and the pressing element constitute substantially V-shaped grooves which, in the case of the pressing element being in its operative or effectual position, are arranged in a plane extending substantially perpendicular to the axis of rotation of the support arrangement.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
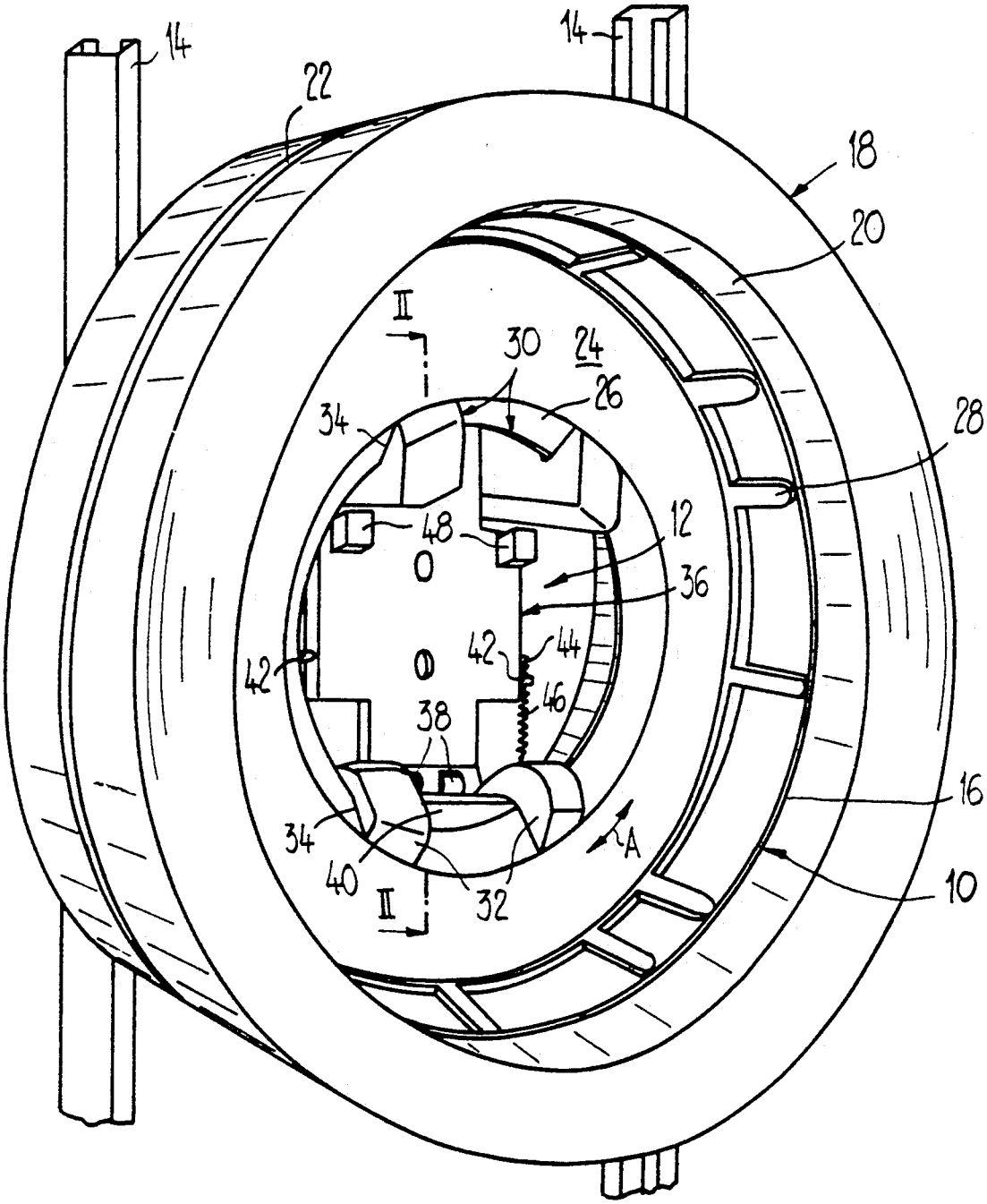
FIG. 1 schematically shows a perspective view of an embodiment of the inventive apparatus containing a support arrangement at which a hollow, substantially cylindrical winding core is clamped or fixedly but releasably held.

Describing now the drawings, it is to be understood that in order to simplify the illustration thereof, only enough of the construction of the exemplary embodiment of apparatus for rotatably supporting a hollow, substantially cylindrical winding core and of the structure of the inventive winding core has been shown therein as is needed to enable one skilled in the art to readily understand the underlying principles and concepts of the present invention. Turning attention now specifically to FIG. 1 of the drawings, the apparatus illustrated therein by way of example and not limitation will be seen to comprise a winding core or mandrel 10 which is clamped at a support arrangement 12 rotatably supported at a suitable bearing or mounting block or equivalent structure not particularly shown in FIG. 1. This bearing or mounting block is elevationally adjustably mounted in known but not specifically shown manner at rails or guides 14.

The winding core or mandrel 10 is hollow and substantially cylindrical and comprises on its external or outer side a supporting or carrying surface 16 which carries or bears a product coil or wound package 18 formed of printed products 20 only schematically indicated in the drawing. The printed products 20, together with a winding strap or band 22, are wound up in known manner upon the winding core or mandrel 10, one end of the winding strap or band 22 being fixedly attached to the winding core or mandrel 10, while the other end of the winding strap or band 22 embraces or encircles the product coil or wound package 18 in order to hold together the individual layers or convolutions of the product coil or wound package 18. The winding core or mandrel 10 comprises an annular rim or rib 24 or the like which projects toward the interior or inner side and is constructed as a mounting or bearing element, the inner end region thereof being constructed as a substantially V-shaped wedge or wedge member 26. Stiffening or bracing bodies or ribs 28 or the like extending in the axial direction of the winding core or mandrel 10 protrude away from the annular rim or rib 24 such that the supporting or carrying surface 16 is adequately stiffened and reinforced.

At the support arrangement 12 there are provided two receiving or supporting claws or claw members 30 structured as support elements, and two clamping or gripping claws or claw members 32 structured as pressing or contact elements and situated substantially diametrically opposite the support elements. The receiving or supporting claws 30 and the clamping or gripping claws 32 comprise substantially V-shaped grooves or recesses 34 which bear against the substantially V-shaped wedge 26 of the winding core or mandrel 10. The receiving or supporting claws 30 and the clamping or gripping claws 32 thus form a clamping or fixation or holding arrangement for the winding core or mandrel 10 and releasably clamp the latter to the support arrangement 12.

As shall be further described hereinafter, the clamping or gripping claws 32 are pivotably mounted such that they can be disengaged from the substantially V-shaped wedge 26, and the winding core or mandrel 10 together with the printed products 20 wound up thereupon to form a product coil or wound package 18 can be lifted from the receiving or supporting claws or claw members 30. As shall also be hereinafter described in more detail, a substantially plate-shaped lever or lever member 36 is pivotably mounted at the receiving or supporting claws 30, such substantially plate-shaped lever 36 having at its free end rotatably supported rolls or rollers 38. A substantially plate-shaped roll-on or rolling contact cam 40 or the like fastened to the two clamping or gripping claws 32 connects or joins the latter to one another and is supported at the rolls or rollers 38. At the plate-shaped lever 36 there are arranged two laterally projecting pins or pin members 42, at each of which a first spring 44 or equivalent structure and a second spring 46 or equivalent structure engage, only one of each spring being shown in FIG. 1. Each second spring 46 is fastened at its one end to one of the pins 42 and at its other end to the respective or associated clamping or gripping claw 32. The first springs 44 bias the plate-shaped lever 36 into a resting position, while the second springs 46 bias the clamping or gripping claws 32 into an idle position. Safety stop cams or cam members 48 or the like are provided at the plate-shaped lever 36. The function of such safety stop cams 48 will be described further below. For the sake of good order it should be mentioned that the support arrangement 12 and thus the winding core or mandrel 10 clamped thereat and containing the product coil or wound package 18 are rotatably supported or mounted at the not particularly illustrated bearing or mounting block for selective rotation in one or the other direction of the double-headed arrow A.

Figure 2:
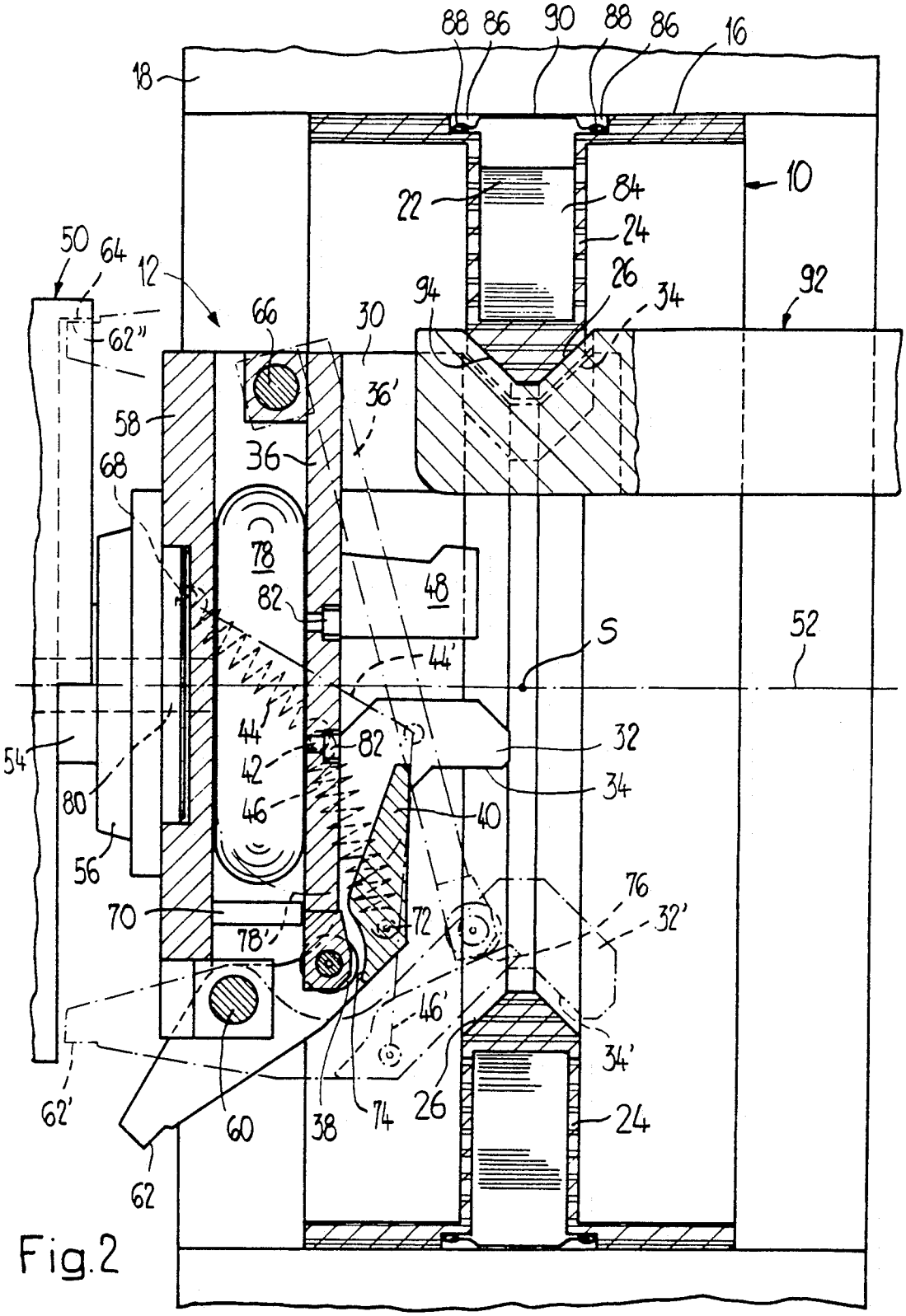
FIG. 2 schematically shows, on an enlarged scale, a vertical section taken substantially along the line II—II of FIG. 1.

FIG. 2 shows a section taken substantially along the line II—II of FIG. 1, the product coil or wound package 18 and the bearing or mounting block 50 being only partially shown therein. As described hereinbefore, the bearing or mounting block 50 or equivalent structure is appropriately elevationally adjustably supported at rails or guides 14 (cf. FIG. 1) not particularly shown in FIG. 2. At the bearing or mounting block 50 there is supported a rotatably drivable hollow shaft or shaft member 54 for rotation about its axis of rotation 52 indicated in dash-dotted lines. This hollow shaft 54 carries a flange or flange member 56 at which a substantially plate-shaped holding or supporting element 58 of the support arrangement is fixedly secured. The two receiving or supporting claws 30 are fastened to the plate-shaped holding or supporting element 58. In the substantially vertical section of FIG. 2 only one of the two receiving or supporting claws 30 is visible. These two receiving or supporting claws 30 protrude away from the plate-shaped holding or supporting element 58 in a direction substantially parallel to the axis of rotation 52 and comprise in the end regions or portions thereof the aforesaid V-shaped grooves or recesses 34 which, as viewed or regarded in radial direction, are open toward the exterior.

The one clamping or gripping claw 32 visible in FIG. 2 is shown in full lines in the idle or ineffectual position and in dash-dotted lines in an operative or effectual position designated with the reference numeral 32'. The clamping or gripping claw 32 is constructed as a two-armed or double-arm lever pivotably mounted at a shaft or shaft member 60 arranged at the plate-shaped holding or supporting element 58. The axis of the shaft 60 extends in a direction substantially perpendicular to the axis of rotation 52 and is arranged in spaced relationship to the latter. In this connection it is worthy of mention that both clamping or gripping claws 32 shown in FIG. 1 are supported at the single mutual or common shaft 60. At a not particularly referenced arm of the clamping or gripping claw 32, such arm projecting toward the bearing or mounting block 50, there is formed a nose or lug 62 or the like which, in the operative position 32' of the respective clamping or gripping claw 32, extends in a direction substantially parallel to the axis of rotation 52. This position of the nose or lug 62 is designated with the reference numeral 62' and indicated in dash-dotted lines.

At the bearing or mounting block 50 there is provided a safety cam or cam member 64 or the like extending above the axis of rotation 52 and coaxially arranged with respect to the latter. This safety cam 64 projects in the direction toward the plate-shaped holding or supporting element 58 and prevents the back-pivoting or retro-movement of the clamping or gripping claw 32 from the operative position 32' into the idle position shown in full lines, as soon as the nose or lug 62 in its operative position 62' arrives in the region or range of the safety cam 64 during rotation of the support arrangement 12 about the axis of rotation 52. The nose or lug 62, in the operative position 62', is in the top or upper end position, in which such nose or lug 62 cooperates with the safety cam 64, again indicated in dash-dotted lines and denoted by the reference numeral 62''.

Each clamping or gripping claw 32 is provided with a substantially V-shaped groove or recess 34 in the region of a respective or associated arm located remote from the bearing or mounting block 50. In the clamping or gripping claw 32 in the operative position 32' thereof, the V-shaped groove 34 now designated with the reference numeral 34' is, as viewed or regarded in radial direction, open toward the exterior or outside and arranged in the same plane in which the V-shaped groove 34 of the receiving or supporting claw 30 is also arranged, such plane extending substantially perpendicular to the axis of rotation 52. As also shown in FIG. 1, the clamping or gripping claws 32 arranged in a laterally spaced relationship from each other in the direction of the axis of the shaft 60 are operatively connected or joined to each other by means of the plate-shaped roll-on or rolling contact cam 40. The operation of this roll-on or rolling contact cam 40 will be described further below.

A further shaft or shaft member 66 is secured at the receiving or supporting claws 30 arranged at a laterally spaced relationship from one another. The lengthwise or longitudinal axis of this further shaft 66 extends substantially parallel to the shaft 60. The plate-shaped lever 36 is pivotably supported at the further shaft 66 and shown in full lines in the resting position thereof. The plate-shaped lever 36 in a working position is indicated in dash-dotted lines and designated with the reference numeral 36'.

As further shown in FIG. 2, each first spring 44 acts at one end thereof on the respective pin 42 fastened to the plate-shaped lever 36 and at the other end thereof on a further respective pin or pin member 68 fastened to the plate-shaped holding or supporting element 58. These two first springs 44 bias the plate-shaped lever 36 toward the resting position thereof in which the latter bears against a stop or abutment 70 arranged at the plate-shaped holding or supporting element 58. Each second spring 46, which at one end thereof is also fixedly attached to the respective pin 42, is fastened at its other end to a further respective pin or pin member 72 arranged at the respective or associated clamping or gripping claw 32. These two second springs 46 bias the clamping or gripping claws 32 in the idle position thereof in which the latter abut against the plate-shaped lever 36. The lines of action of the first springs 44 and the second springs 46 in the working position of the plate-shaped lever 36 and the operative position of the clamping or gripping claws 32 are indicated in dash-dotted lines and designated with the reference numerals 44' and 46', respectively.

The two rolls or rollers or cam followers 38, of which only one is visible in FIG. 2, are rotatably mounted at the free end of the plate-shaped lever 36. When the plate-shaped lever 36 is pivoted in counterclockwise direction from the resting position thereof into the working position denoted by the reference numeral 36', the rolls or rollers 38 come to bear against a first segment or section 74 of the roll-on or rolling contact track of the plate-shaped roll-on or rolling contact cam 40 and, due to further movement of the rolls or rollers 38, pivot in clockwise direction the clamping or gripping claws 32 out of the idle position thereof and into the operative position denoted by the reference numeral 32'. It should thus be noted that the plate-shaped lever 36 in the working position 36' stands approximately perpendicular upon a second segment or section 76 of the roll-on track of the plate-shaped roll-on or rolling contact cam 40. The bend or buckle in the roll-on or rolling contact track between the first segment or section 74 and the second segment or section 76 results in that in a first range of pivoting or rotating motion of the plate-shaped lever 36 the clamping or gripping claws 32 carry out a large angle or traverse in the direction toward the operative position 32', and that in the subsequent range of pivoting or rotating motion of the plate-shaped lever 36 the angle of traverse of the clamping or gripping claws 32 is relatively small.

The safety stop cams 48 arranged at the plate-shaped lever 36, of which only one is to be seen in FIG. 2, delimit the pivot angle or angle of traverse of the plate-shaped lever 36 in that the free top or upper ends of the safety stop cams 48 abut against the bottom or lower side of the receiving or supporting claws 30 in the event that the plate-shaped lever 36 is pivoted into the working position without a winder core or mandrel 10 having been deposited for clamping thereof.

An inflatable bellows or bag 78 or the like is provided between the plate-shaped holding or supporting element 58 and the plate-shaped lever 36. The outlines of the inflated bellows or bag 78 are indicated in dash-dotted lines and designated with the reference numeral 78'. The hollow space or chamber of the inflatable bellows or bag 76 is connected, via a central bore 80 in the plate-shaped holding or supporting element 58 and in the flange 56 as well as in the hollow shaft 54, with a suitable source of pressure not particularly shown in the drawing. The inflatable bellows or bag 78 is fixedly attached to the plate-shaped lever 36 by means of two screw or threaded bolts 82 such that the bellows or bag 78 in the inflated condition 78' cannot slide away downwards.

The product coil or wound package 18 is wound up on the supporting or carrying or bearing surface 16 of the winding core or mandrel 10. As particularly depicted in FIG. 2, the annular rim or rib 24 projecting toward the interior or inner side is constructed at the free end thereof as a substantially V-shaped wedge 26. In the annular rim or rib 24 there is provided an annular groove or recess 84 which is open toward the external or outer side of the winding core or mandrel 10. In this annular groove 84 a part or portion of the winding strap or band 22 is wound up, such strap or band part or portion not being required for the formation of the product coil or wound package 18. As described hereinbefore, one end of the winding strap or band 22 is fastened at the bottom or floor of the annular groove 84 to the winding core or mandrel 10. In the case of an empty winding core or mandrel 10, the complete or entire winding strap or band 22 is wound up in the annular groove 84.

The annular groove 84 is widened or broadened in the region of the supporting or carrying surface 16, so that the latter forms two recesses 86 arranged in spaced relationship to each other. In each recess 86 there is arranged an annular or circumferential guide or guide member 88. An annular cover or covering or closure 19 is slidably supported in the two annular or circumferential guides 88. The annular cover or covering 19 comprises a slot for the withdrawal of the winding strap or band 22 from the annular groove 84, such slot extending in a direction substantially parallel to the longitudinal axis of the winding core or mandrel 10. The center of gravity S of the winding core or mandrel 10 or of the product coil or wound package 18 wound up thereupon is located in a plane extending transversely to the axis of rotation 52 and in which plane the V-shaped grooves 34 and 34' are arranged.

A cantilever or support arm or arm member 92 of a not particularly shown handling device such as, for example, a forklift truck or stacker or the like, is shown partially in section. The free end of the cantilever or support arm 92 comprises a V-shaped receiving groove 94 for the V-shaped wedge 26 of the winding core or mandrel 10. The cantilever or support arm 92 located between the two receiving or supporting claws 30 laterally spaced from each other bears against the annular rim or rib 24 of the winding core or mandrel 10 and is displaceable by means of the handling device in a direction substantially parallel to the axis of rotation 52 and transversely thereto.

Having now had the benefit of the foregoing description of the exemplary embodiment of the apparatus for rotatably supporting a hollow, substantially cylindrical winding core or mandrel 10, there will now be described the operation thereof which is as follows:

Before a winding core or mandrel 10 can be brought to bear against the receiving or supporting claws 30, the support arrangement 12 is to be brought into the position shown in FIGS. 1 and 2, in which the two receiving or supporting claws 30 are overhead or at the top. The inflatable bellows or bag 78 is pressureless with respect to ambient or atmospheric air so that the plate-shaped lever 36 is in the resting or rest position and the two clamping or gripping claws 32 are in the idle or ineffectual position due to the tensile force of the first springs 44 and the second springs 46, respectively.

The winding core or mandrel 10 is brought to bear upon the receiving or supporting claws 30 by means of the handling device in that the cantilever or support arm 92 is between the two receiving or supporting claws 30 and subsequently lowered such that the V-shaped wedge 26 rests in the V-shaped grooves 34 of the receiving or supporting claws 30. The V-shaped structure of the annular rim or rib 24 as well as of the grooves 34 thus ensure a positive reception and centering of the winding core or mandrel 10, even when the cantilever or support arm 92 is not precisely or exactly positioned. As soon as the V-shaped wedge 26 of the annular rim or rib 24 is seated in the V-shaped grooves 34, the cantilever or support arm 92 can be further lowered and then moved or driven out in a direction substantially parallel to the axis of rotation 52.

Since the center of gravity S of the winding core or mandrel 10 is located in the same plane in which the V-shaped grooves 34 are also arranged, the longitudinal axis of the winding core or mandrel 10 substantially coincides with the axis of rotation 52.

The inflatable bellows or bag 78 is now connected to the suitable source of pressure and then inflated, with the result that the pivot movement of the plate-shaped lever 36 is effected in counterclockwise direction. The rolls or rollers 36 bear against the first segment 74 and the further movement of the plate-shaped lever 36 causes a pivoting of the clamping or gripping claws 32 in the clockwise direction until the latter bear upon the V-shaped wedge or wedge member 26 of the annular rim or rib 24 of the winding core or mandrel 10. Since the angle between the second segment 76 of the roll-on track of the roll-on or rolling contact cam 40 and the plate-shaped lever 36 is close to 90°, the clamping or gripping claws 32 are pressed with a very high force against the annular rim or rib 24 even with or under a relatively low overpressure or pressure in excess of atmospheric pressure in the inflated bellows or bag 78, the result being a positive clamping or retention of the winding core or mandrel 10 at the support arrangement 12. It should be noted that when the winding core or mandrel 10 is supported at the receiving or supporting claws 30, the pivoting range of the plate-shaped lever 36 is limited by the segment 76 and the safety stop cams 48 do not bear against the receiving or supporting claws 30.

When the support arrangement 12 rotates about the axis of rotation 52, the winding core or mandrel 10 is automatically entrained or co-rotated. During this rotation of the support arrangement 12, the receiving or supporting claws 30 and the clamping or gripping claws 32 have to alternately carry the weight or load of the winding core or mandrel 10 and that of the product coil or wound package 18 possibly wound-up thereupon. Since, as already mentioned hereinbefore, the plate-shaped lever 36 extends nearly perpendicular to the second segment 76 of the plate-shaped roll-on or rolling contact cam 40, the plate-shaped lever 36 is thus subjected to pressure and the reaction on the inflated bellows or bag 78 is relatively small. In order to nevertheless ensure that, in the event of an unforeseen pressure loss in the inflated bellows or bag 78, the winding core or mandrel 10 remains firmly clamped at the support arrangement 12, the nose or lug 62 travels past the region of the safety cam 64 every time the clamping or gripping claws 32 have to take on a considerable or major portion of the weight or load of the winding core or mandrel 10 and that of the product coil or wound package 18 wound up thereupon. It is readily conceivable that when the clamping or gripping claws 32 are in the operative or effectual position 32', there is an air gap between the noses or lugs 62' and the safety cam 64 such that the noses or lugs 62' slide along the safety cam 64 only in the event of a pressure loss in the inflated bellows or bag 78.

As soon as the winding procedure is terminated, the rotation about the axis of rotation 52 is braked and the support arrangement 12 is rotated or turned into the position depicted in FIGS. 1 and 2 in which the two receiving or supporting claws 30 are overhead or at the top. By venting or blowing air out of the bellows or bag 78 and thus deflating the latter, the plate-shaped lever 36 and the clamping or gripping claws 32 are pivoted back into the resting position and idle position, respectively. The winding core or mandrel 10 is now free and can be removed from the support arrangement 12 by means of the cantilever or support arm 92 of the handling device. The apparatus is now ready for receiving a further winding core or mandrel 10.

The hereinbefore described apparatus for rotatably supporting a hollow, substantially cylindrical winding core or mandrel 10 is particularly suitable for winding stations as disclosed, for example, in the above referenced European Patent Publication No. 0,236,561 and its cognate U.S. patent application Ser. No. 07/005,698, filed Jan. 22, 1987. The winding-up of a stream of printed products arriving, for example, in an imbricated formation, can be carried out in the following manner:

An empty winding core or mandrel 10 is, as already mentioned, deposited on the receiving or supporting claws 30 and clamped at the supporting or support arrangement 12 by means of the clamping or gripping claws 32. The outer or external end of the winding strap or band 22 is fastened to a spool member or take-up roll as described in greater detail in the abovementioned U.S. patent application Ser. No. 07/005,698. By rotation of the spool member or take-up roll, the winding strap or band 22 is wound off from the reserve of winding strap or band 22 wound up in the groove 84. The hollow shaft 54 is thereby slightly braked in order that the winding strap or band 22 is firmly wound up and in a taut state at the spool member or take-up roll. When the winding strap or band 22 is unwound from the winding core or mandrel 10, the winding core or mandrel or body 10 obviously rotates about the axis of rotation 52, while the cover or covering or closure 90 stands still relative to the surroundings or environment, but moves in the annular guides 88 with respect to the winding core or mandrel 10. In this manner, the slot arranged in the cover or covering or closure 90 for the winding strap or band 22 remains in place.

As soon as sufficient winding strap or band 22 is unwound from the winding core or mandrel 10 for the product coil 18 to be formed, and then wound up at the spool member or take-up roll, the hollow shaft 54 and with it the support arrangement 12 of the winding core or mandrel 10 is driven in the winding-up direction. The infed printed products 20 are wound up on the winding core or mandrel 10 conjointly with the winding strap or band 22 now unwound from the spool or take-up roll member. It is thus to be noted that the supporting or carrying surface 16 together with the cover or covering 90 form a substantially cylindrical surface. As soon as sufficient printed products 20 have been wound up to form a product coil or wound package 18, the winding strap or band 22 is guided around the completed product coil 18 by one full turn or convolution and the free end of the latter is joined to the winding strap or band 22, so that a self-supporting wound package is formed as shown in FIG. 1. The winding core or mandrel 10 with the product coil or wound package 18 can now be lifted from the support arrangement 12 by means of the handling device.

Naturally, the apparatus can also be employed for unwinding printed products 20 from a product coil or wound package 18, again the winding core or mandrel 10 containing the product coil or wound package 18 being deposited upon the support arrangement 12 and clamped thereto. By drawing or pulling off the winding strap or band 22, the support arrangement 12 is rotated in the unwinding direction and the printed products 20 are separated or detached in known manner from the product coil or wound package 18. As soon as all the printed products 20 have been unwound from the product coil or wound package 18, the support arrangement 12 is braked and then driven in the winding direction, so that the winding strap or band 22 is again wound up on the winding core or mandrel 10 to form a strap or band reserve in the annular groove 84.

It is also conceivable that a preferably V-shaped groove or recess or the like is arranged at the rim or rib 24 of the winding core or mandrel 10, such V-shaped groove being brought to bear against preferably V-shaped wedges which are correspondingly structured at the receiving or supporting claws 30 and the clamping or gripping claws 32. Furthermore, it is also possible that two receiving or supporting claws 30 and a single clamping or gripping claw 32 are provided. In this case, the single clamping or gripping claw 32 is preferably arranged in a plane of symmetry in which the axis of rotation 52 is located and to which the two receiving or supporting claws 32 are symmetrically arranged. The two receiving or supporting claws 30 and the single clamping or gripping claw 32 are preferably arranged to form an equilateral triangle. However, it is also conceivable that only a single receiving or supporting claw 30 and only a single clamping or gripping claw 32 are provided. In such a case, the two claws would be arranged diametrically opposite each other and preferably structured to have a greater width in order to bear upon the rim or rib 24 across a larger region or range in the circumferential direction.

It will be understood that the pressing element or pressing means, i.e. the clamping or gripping claws 32, are not necessarily pivotably mounted. They can also be structured, for instance, to be displaceable or movable in the radial direction. Finally, it is also conceivable that the support element and the pressing element are mounted to be displaceable and/or pivotable.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for rotatably supporting a hollow, substantially cylindrical winding core for rotation about a longitudinal axis thereof and for carrying on an external side thereof a coil formed of flexible, substantially flat products, especially printed products, comprising:

a support arrangement having an axis of rotation and said support arrangement being rotatably supported for rotation about said axis of rotation;

said axis of rotation substantially coinciding with said longitudinal axis of said winding core releasably clamped to said support arrangement;

said support arrangement comprising at least one support element, at least one pressing element, and a holding element rotatable about said axis of rotation;

said at least on support element being structured such that the winding core can be brought to bear thereupon and said at least one support element being fixedly mounted at said holding element;

said at least one pressing element having an idle position and an operative position and said at least one pressing element in said operative position being situated substantially diametrically opposite said at least one support element;

said at least one pressing element being structured for being brought from said idle position into said operative position for pressing said winding core against said at least one support element;

pivotably supporting means for pivotably supporting said at least one pressing element at said holding element for pivotal movement about a pivot axis defined by said pivotably supporting means;

said pivot axis extending in a direction substantially perpendicular to said axis of rotation of said support arrangement;

said at least one support element together with said at least one pressing element forming a clamping arrangement;

said clamping arrangement releasably clamping said winding core to said support arrangement;

drive means for pivoting said at least one pressing element selectively between said idle position and said operative position;

said drive means comprising a lever pivotably supported at said holding element;

said lever having a resting position and a working position;

said lever being selectively pivotable between said resting position and said working position;

said lever having a free end; and said at least one pressing element in said operative position being supported at said free end of said lever when in said working position.

2. The apparatus as defined in claim 1, wherein:

said at least one support element being fixedly mounted at said holding element at one end and having a free end at another end and said at least one pressing element being supported by said pivotably supporting means at one end and having a free end at another end;

each said at least one support element and said at least one pressing element comprise a respective portion at the respective free end; and each of said portions possessing a substantially V-shaped configuration structured to be capable of being brought to bear against said winding core.

3. The apparatus as defined in claim 2, wherein:

each of said portions comprise a respective substantially V-shaped groove;

said substantially V-shaped groove of said at least one support element and said substantially V-shaped groove of said at least one pressing element in said operative position being arranged in a plane; and said plane extending substantially perpendicular to said axis of rotation of said support arrangement.

4. The apparatus as defined in claim 1 wherein:

said winding core includes at an internal side thereof, a mounting element for rotatable and removable support of said winding core at a support arrangement; and said mounting element comprises a substantially V-shaped cross-section.

5. The apparatus as defined in claim 4 wherein:

said mounting element comprises an annular rim projecting toward the inside of said winding core; and said annular rim being constructed as an essentially V-shaped wedge.

6. The apparatus as defined in claim 5 wherein:

said winding core further includes a winding strap;

said annular rim comprising an annular groove for accommodating said winding strap; and said annular groove being open toward the external side of said winding core.

7. The apparatus as defined in claim 6 wherein:

said annular rim is arranged in a plane extending substantially perpendicular to a longitudinal axis of said winding core;

said winding core having a center of gravity; and said center of gravity being located in said plane.

8. The apparatus as defined in claim 4 wherein:

said mounting element comprises an annular rim projecting toward the inside of said winding core;

said annular rim comprising a substantially V-shaped groove; and said substantially V-shaped groove being open toward the interior of said winding core.

9. The apparatus as defined in claim 8 wherein:

the winding core further includes a winding scrap;

said annular rim comprising an annular groove for accommodating said winding strap; and said annular core being open toward the external side of said winding core.

10. The apparatus as defined in claim 9 wherein:

said annular rim is arranged in a plane extending substantially perpendicular to a longitudinal axis of said winding core;

said winding core having a center of gravity; and said center of gravity being located in said plane.

11. The apparatus as defined in claim 1, wherein:

said at least one pressing element comprises two pressing elements; and said two pressing elements in said operative position being supported at said free end of said lever when in said working position.

12. The apparatus as defined in claim 1, further including:

means for biasing said at least one pressing element toward said idle position; and said at least one pressing element being pivotable into said operative position by means of said lever.

13. The apparatus of claim 12, wherein:

said at least one support element constituting two support elements arranged in spaced relationship to one another; and said at least one pressing element constituting two pressing elements.

14. The apparatus as defined in claim 13, wherein:

said lever comprises a substantially plate-shaped lever.

15. The apparatus as defined in claim 13, further including:

at least one roll rotatably supported at said free end of said lever;

a substantially plate-shaped roll-on cam arranged between and secured at said two pressing elements;

said at least one roll being structured for being brought to bear against said substantially plate-shaped roll-on cam;

said substantially plate-shaped roll-on cam having a segment adjacent to said at least one roll in said idle position of said two pressing elements;

said segment extending in a direction substantially parallel to said lever when in said resting position;

said substantially plate-shaped roll-on cam having a further segment; and said further segment in said operative position of said two pressing elements being located at said at least one roll of said lever in said working position and extending in a direction substantially perpendicular to said lever.

16. The apparatus as defined in claim 15, further including:

means for biasing said lever toward said resting position;

said drive means comprising an inflatable bellows arranged between said lever and said holding element; and said inflatable bellows serving for bringing said lever into said working position.

17. The apparatus as defined in claim 16, further including:

a rotatably mounted hollow shaft;

said holding element being secured at said hollow shaft; and said inflatable bellows being in flow connection via said hollow shaft with a source of compressed air.

18. An apparatus for rotatably supporting a hollow, substantially cylindrical winding core for rotation about a longitudinal axis thereof and for carrying on an external side thereof a coil formed of flexible, substantially flat products, especially printed products, comprising:

a support arrangement having an axis of rotation and being rotatably supported for rotation about said axis of rotation;

said axis of rotation substantially coinciding with said longitudinal axis of said winding core releasably clamped to said support arrangement;

said support arrangement comprising at least one support element, at least one pressing element, and a holding element rotatable about said axis of rotation;

said at least on support element being structured such that the winding core can be brought to bear thereupon and said at least one support element being fixedly mounted at said holding element;

said at least one pressing element having an idle position and an operative position and said at least one pressing element in said operative position being situated substantially diametrically opposite said at least one support element;

said at least one pressing element being structured for being brought from said idle position into said operative position for pressing said winding core against said at least one support element;

pivotably supporting means for pivotably supporting said at least one pressing element at said holding element for pivotal movement about a pivot axis defined by said pivotably supporting means;

said pivot axis extending in a direction substantially perpendicular to said axis of rotation of said support arrangement;

said at least one support element together with said at least one pressing element forming a clamping arrangement;

said clamping arrangement releasably clamping said winding core to said support arrangement;

drive means for pivoting said at least one pressing element selectively between said idle position and said operative position;

said drive means comprising a lever pivotably supported at said at least one support element;

said lever having a resting position and a working position;

said lever being selectively pivotable between said resting position and said working position;

said lever having a free end; and said at least one pressing element in said operative position being supported at said free end of said lever when in said working position.

19. The apparatus of claim 18, wherein:

said at least one support element constituting two support elements arranged in spaced relationship to one another; and said at least one pressing element constituting two pressing elements.

20. The apparatus as defined in claim 19, further including:

means for biasing said two pressing elements toward said idle position; and said two pressing elements being pivotable into said operative position by means of said lever.

21. The apparatus as defined in claim 20, wherein:

said lever comprises a substantially plate-shaped lever.

22. The apparatus as defined in claim 20, further including:

at least one roll rotatably supported at said free end of said lever;

a substantially plate-shaped roll-on cam arranged between and secured at said two pressing elements;

said at least one roll being structured for being brought to bear against said substantially plate-shaped roll-on cam;

said substantially plate-shaped roll-on cam having a segment adjacent to said at least one roll in said idle position of said two pressing elements;

said segment extending in a direction substantially parallel to said lever when in said resting position;

said substantially plate-shaped roll-on cam having a further segment;

said further segment in said operative position of said two pressing elements being located at said at least one roll of said lever in said working position and extending in a direction substantially perpendicular to said lever.

23. The apparatus as defined in claim 22, further including:

means for biasing said lever toward said resting position;

said drive means comprising an inflatable bellows arranged between said lever and said holding element; and said inflatable bellows serving for bringing said lever into said working position.

24. The apparatus as defined in claim 23, further including:

a rotatably mounted hollow shaft;

said holding element being secured at said hollow shaft; and said inflatable bellows being in flow connection via aid hollow shaft with a source of compressed air.

25. An apparatus for winding or unwinding flexible, substantially flat products, especially printed products, on a product coil, comprising:

a substantially hollow, substantially cylindrical winding core rotatable about a longitudinal axis thereof, said winding core having at an external side thereof, a supporting surface for carrying a coil formed of said flexible, substantially flat products and having at an internal side thereof, a mounting element comprising a substantially V-shaped cross-section;

a support arrangement comprising at least one support element and at least one pressing element;

said at least one support element having a substantially V-shaped groove adapted to engage said V-shaped mounting element;

said at least one pressing element having a substantially V-shaped groove adapted to engage said V-shaped mounting element;

said substantially V-shaped groove of said at least one support element and said substantially V-shaped groove of said at least one pressing element in said operative position being arranged in a plane;

said plane extending substantially perpendicular to said axis of rotation of said support arrangement;

said at least one pressing element having an idle position and an operative position;

said at least one pressing element being structured for being brought from said idle position into said operative position for pressing said winding core against said at least one support element;

said at least one support element together with said at least one pressing element forming a clamping arrangement;

said clamping arrangement releasably clamping said winding core to said support arrangement;

said support arrangement having an axis of rotation and being rotatably supported for rotation about said axis of rotation; and said axis of rotation substantially coinciding with said longitudinal axis of said winding core releasably clamped to said support arrangement.

* * * * *

UNITED STATES PATENT AND TRADEMARK OFFICE

CERTIFICATE OF CORRECTION

PATENT NO. : 4,993,653

DATED : February 19, 1991

INVENTOR(S) : Hans Frei

It is certified that error appears in the above-identified patent and that said Letters Patent is hereby corrected as shown below:

Col. 12, claim 1, line 16, please delete "on" and substitute therefor --one--.

Col. 14, claim 9, line 2, please delete "scrap" and substitute therefor --strap--; and in line 5, please delete "core" and substitute therefor --groove--.

Col. 15, claim 18, line 23, please delete "on" and substitute therefor --one--.

Col. 16, claim 24, line 7, please delete "aid" and substitute therefor --said--.

Signed and Sealed this

Twentieth Day of October, 1992

*Attest:*

DOUGLAS B. COMER

*Attesting Officer*

*Acting Commissioner of Patents and Trademarks*